US009897958B2

(12) United States Patent
Kuroki

(10) Patent No.: US 9,897,958 B2
(45) Date of Patent: Feb. 20, 2018

(54) IMAGE FORMING APPARATUS FOR CORRECTING A PULSE WIDTH THAT IS BASED ON A CLOCK SIGNAL

(71) Applicant: CANON KABUSHIKI KAISHA, Tokyo (JP)

(72) Inventor: Kenji Kuroki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/334,710

(22) Filed: Oct. 26, 2016

(65) Prior Publication Data

US 2017/0146938 A1 May 25, 2017

(30) Foreign Application Priority Data

Nov. 20, 2015 (JP) ..... 2015-228089

(51) Int. Cl.
*G03G 15/00* (2006.01)

(52) U.S. Cl.
CPC ..... *G03G 15/5045* (2013.01); *G03G 15/80* (2013.01)

(58) Field of Classification Search
CPC ..... G03G 15/5045; G03G 15/80
See application file for complete search history.

(56) References Cited

U.S. PATENT DOCUMENTS 8,577,243 B2 11/2013 Tamaoki
2015/0338763 A1* 11/2015 Azumai ..... G03G 21/14 347/132

FOREIGN PATENT DOCUMENTS

JP 2011-186231 A 9/2011

* cited by examiner

*Primary Examiner* — Sophia S Chen
(74) *Attorney, Agent, or Firm* — Fitzpatrick, Cella, Harper & Scinto

(57) ABSTRACT

An image forming apparatus that includes a first control unit and a second control unit. The first control unit performs control of a load by outputting a pulse signal based on a clock signal output by a first oscillator. The second control unit is connected to the first control unit by a serial communication signal line, and performs control of a load by outputting a pulse signal based on a clock signal output by a second oscillator. The second control unit measures a width of the pulse signal output from the first control unit via the serial communication signal line, compares a pulse signal width designated by an adjustment request with the measured width of the pulse signal, and corrects, based on a result of the comparing, the width of the pulse signal that is based on the clock signal output by the second oscillator.

9 Claims, 11 Drawing Sheets

IMAGE FORMING APPARATUS FOR CORRECTING A PULSE WIDTH THAT IS BASED ON A CLOCK SIGNAL

BACKGROUND OF THE INVENTION

Field of the Invention

The present invention relates to an image forming apparatus.

Description of the Related Art

Conventionally, in an electronic device such as an image forming apparatus, to control actuators such as stepping motors, DC brushless motors, or the like arranged in respective locations, CPUs or ASICs for outputting control signals of motors are arranged by being distributed on a plurality of substrates. In a case of such an arrangement, for connection between a main CPU for outputting an overall control timing instruction for causing rotation of each motor and CPUs or the like arranged on each substrate, 2-line type and 3-line type serial communication modes are commonly used for transmitting with fewer signal lines (for example, Japanese Patent Laid-Open No. 2011-186231).

Conventionally, as a method for causing driving of CPUs or the like connected by a serial communication signal line arranged on each substrate, a method for connecting each substrate to a quartz oscillator, a method for providing a CLK signal on a communication signal line and driving by the CLK signal, or the like are used.

In a case of a configuration that connects the CPU or the like of each substrate to a quartz oscillator, a cost in proportion to the number of quartz oscillators is incurred. In addition, in the case of a method for transmitting a CLK signal together with a serial communication signal, there are problems such as radiant noise, a CLK signal line cost, and operation instability due to external noise on a transfer path.

Accordingly, a configuration for performing control by using an integrated oscillator that is integrated in a CPU or the like as illustrated in FIG. 1 is can be considered. In this configuration, an integrated oscillator and a CPU are provided in each of a main substrate and a sub substrate, and control of a DC brushless motor or a stepping motor connected to each is performed.

Generally an integrated oscillator has a low cost compared to an external quartz oscillator, and is superior from a cost perspective. However, generally, for an integrated oscillator, there is a significant tendency of a change of a frequency characteristic with respect to temperature in comparison to a quartz oscillator. Therefore, in a case of using integrated oscillators to perform control for which precision is necessary for CPUs or the like arranged dispersed on substrates installed at places where the temperature is different in an image forming apparatus, problems arise due to differences of operation due to environmental temperatures of the plurality of integrated oscillators.

SUMMARY OF THE INVENTION

According to one aspect of the present invention, there is provided an image forming apparatus, comprising: a first control unit provided with a first oscillator internally and configured to perform control of a load by outputting a pulse signal based on a clock signal output by the first oscillator; and a second control unit provided with a second oscillator internally, connected to the first control unit by a serial communication signal line, and configured to perform control of a load by outputting a pulse signal based on a clock signal output by the second oscillator, wherein the second control unit measures a width of the pulse signal output from the first control unit via the serial communication signal line, upon receiving an adjustment request from the first control unit; compares a pulse signal width designated by the adjustment request with the measured width of the pulse signal; and corrects, based on a result of the comparing, the width of the pulse signal that is based on the clock signal output by the second oscillator.

By virtue of the present invention, even in a case of using a plurality of substrates each provided with a CPU or the like that uses an integrated oscillator under conditions of temperature change being high in a device, it is possible to realize control with good precision in each substrate.

Further features of the present invention will become apparent from the following description of exemplary embodiments (with reference to the attached drawings).

DESCRIPTION OF THE EMBODIMENTS

Description of Problem to be Solved

Before giving an explanation regarding an embodiment of the present invention, a configuration of a conventional control circuit is used to give an explanation in detail regarding the problem handled by the present invention.

Figure 1:
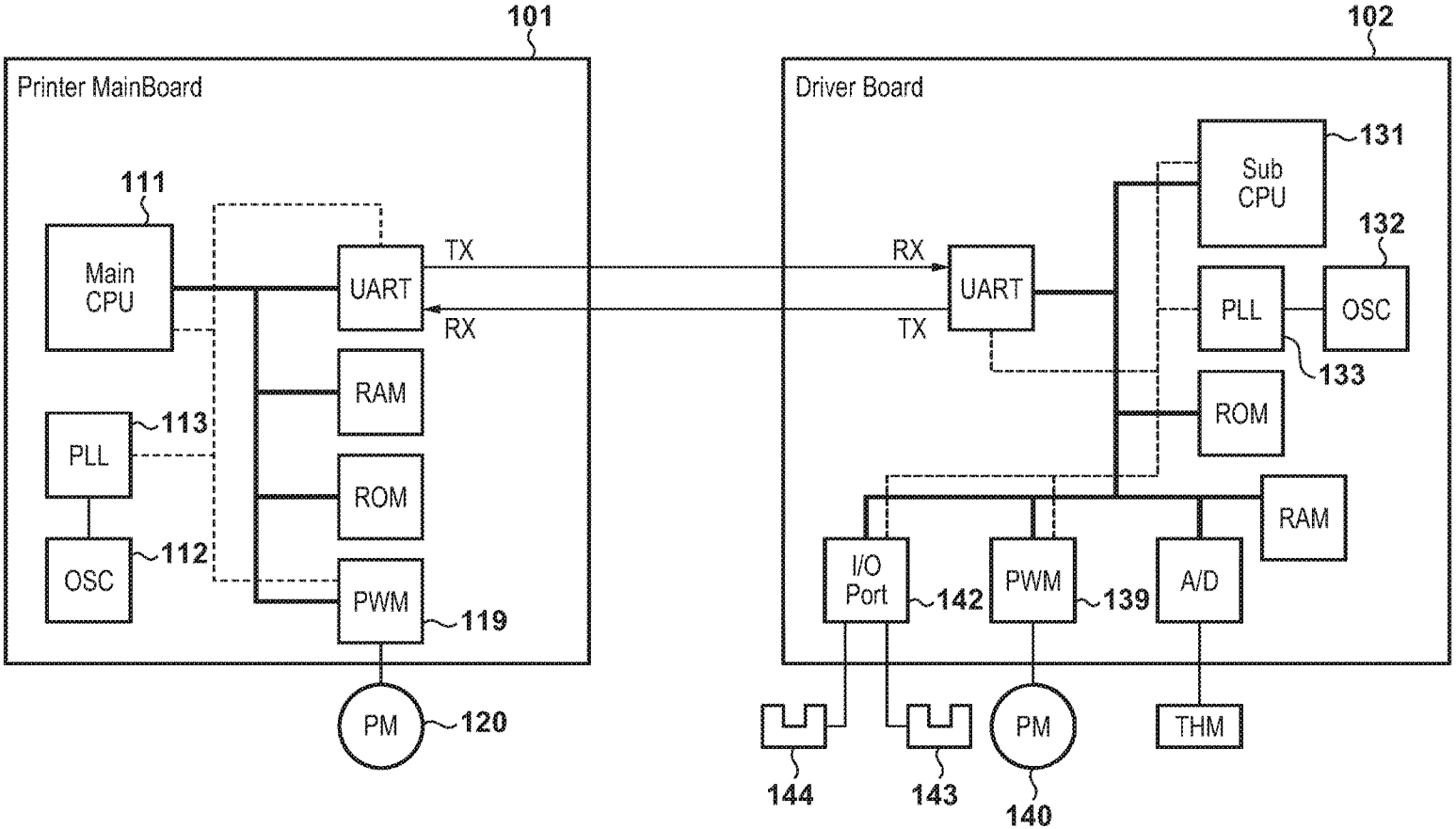
FIG. 1 is a view for describing an example of a conventional circuit configuration.

In a configuration of a conventional control circuit as illustrated in FIG. 1, a main substrate 101 (a printer main board) and a sub substrate 102 (a driver board) are connected by a serial communication signal line. Transmission (TX) and reception (RX) occurs between the main substrate 101 and the sub substrate 102. In the main substrate 101, a main CPU 111, an integrated oscillator 112, a PLL circuit 113, and a PWM control unit 119 are provided. The PLL circuit 113 is a circuit for outputting, for a reference signal input from an external unit, a frequency multiplied by a loop circuit configured by an internal phase comparator or a VCO. In addition, on the sub substrate 102 side, a sub-CPU 131, an integrated oscillator 132, a PLL circuit 133 that multiplies a clock signal generated by the integrated oscillator 132, and a PWM control unit 139 are provided.

Figure 2:
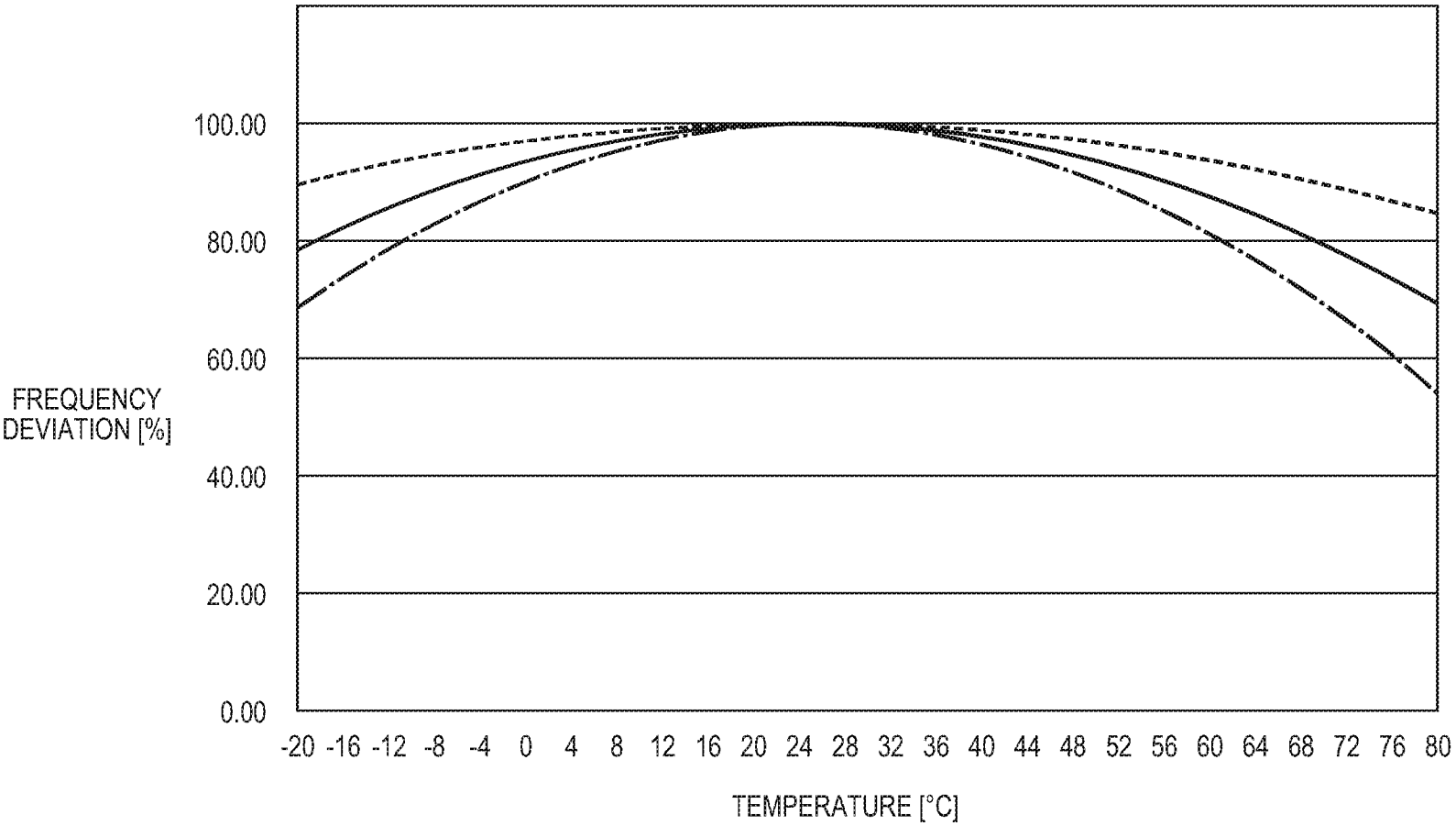
FIG. 2 is a view for describing temperature characteristics of quartz oscillators.
Figure 3:
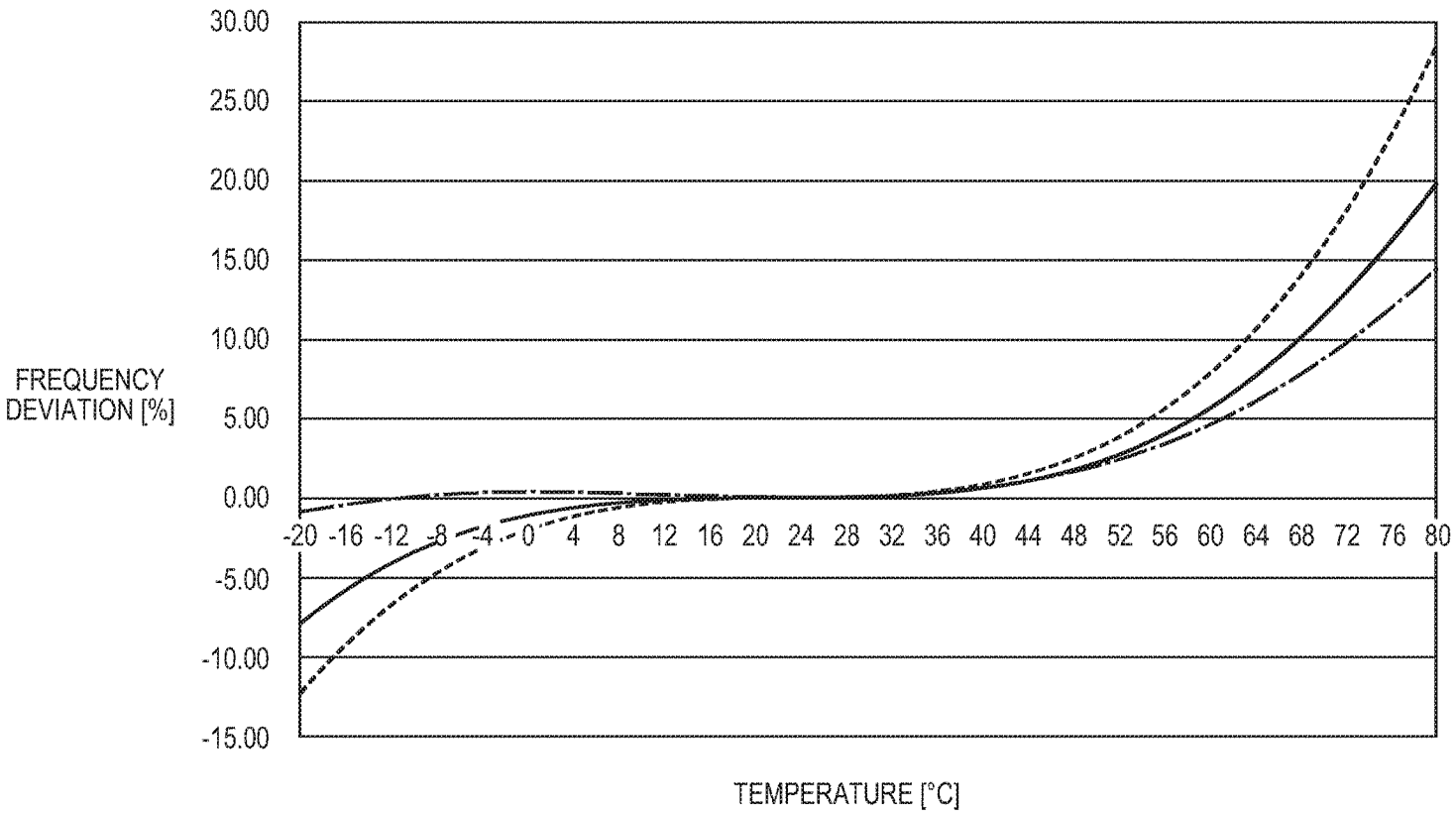
FIG. 3 is a view for describing temperature characteristics of quartz oscillators.

FIG. 2 and FIG. 3 illustrate examples of frequency characteristics in relation to temperature in an integrated oscillator. In FIG. 2 and FIG. 3, the abscissa axis indicates temperature and the ordinate axis indicates a deviation with respect to a reference frequency, and in addition each line respectively indicates the characteristic of an integrated oscillator. With reference to FIG. 2 and FIG. 3, as an integrated oscillator there are ones for which the frequency decreases in low-temperature and high-temperature ranges, ones for which the frequency decreases in low temperatures and increases in high temperatures, and the like, and there are various rates of change for frequency deviation with respect to temperature in accordance with the oscillator.

Figure 4:
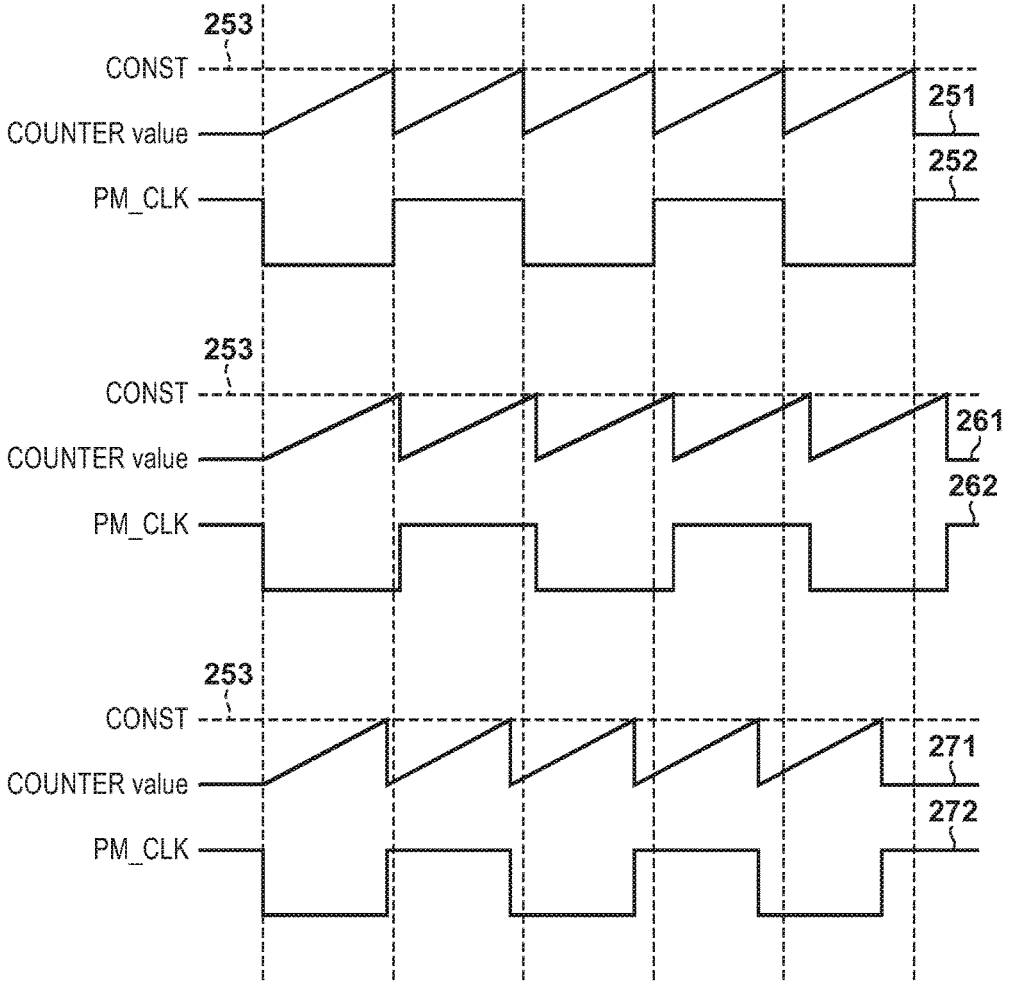
FIG. 4 is a view for describing a motor driving pulse at a time of a temperature fluctuation.

FIG. 4 is used to give an explanation regarding a phenomenon that occurs in a driving pulse of a motor output by an LSI or CPU that uses an integrated oscillator, as a result of the above-described characteristics of integrated oscillators. A timer counter value 251 indicates a value of a timer counter driven by the PLL circuit 133 integrated in the sub-CPU 131. Here, when generating the driving pulse of the motor, a circuit configuration for outputting a motor drive signal by inverting the logic of a motor drive clock pulse 252 when the timer counter value 251 reaches a timer constant 253 is used.

At this point, if the frequency of the clock signal generated by the oscillator becomes a frequency deviation significantly lower than an ideal value as in the temperature range close to −20° C. of FIG. 2, an increment as indicated by a counter fluctuation 261 becomes slower proportional to the frequency. As a result, the frequency of a driving pulse 262 for the motor decreases, and driving speed of the motor slightly decreases. In addition, because, in a temperature range near 80° C. of FIG. 2, the frequency of an oscillator similarly indicates a frequency deviation lower than an ideal value, a similar problem occurs.

At this point, if the frequency of the clock signal generated by the oscillator becomes a frequency deviation significantly higher than an ideal value as with the temperature range close to 80° C. of FIG. 3, an increment as indicated by a counter fluctuation 271 becomes sharp proportional to the frequency. As a result, the frequency of a driving pulse 272 for the motor increases, and driving speed of the motor slightly increases.

Figure 5:
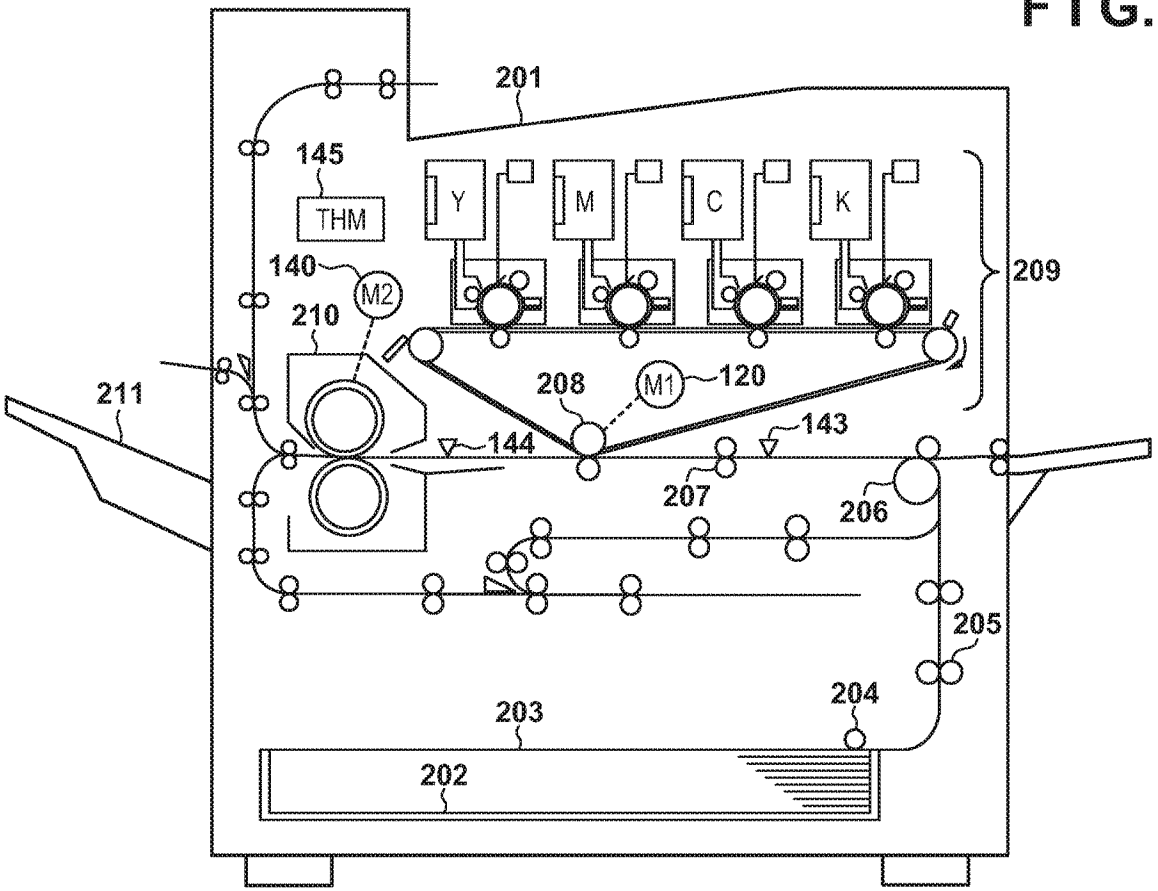
FIG. 5 is a cross-sectional view of an image forming apparatus.

Accordingly, for example, if using an integrated oscillator to perform paper feed control, which requires precision, by LSIs or CPUs arranged in distribution on substrates installed in places having different temperatures in an image forming apparatus as illustrated in FIG. 5, there are cases where problems arise due to differences of speed of a plurality of motors.

An image forming apparatus 201 illustrated in FIG. 5 is an apparatus for performing image formation (printing) on a sheet 203 stored in a sheet cassette 202. The sheet 203 is a recording medium such as paper, and is pulled from the sheet cassette 202 by a sheet feed roller 204. The sheet 203 fed from the sheet cassette 202 is further conveyed upward upon reaching a vertical path roller 205, and is further conveyed until a conveyance roller 206 and a registration roller 207.

An image forming unit 209 has a function of forming a visible electrophotographic toner images including four colors—yellow (Y), magenta (M), cyan (C), and black (K)—on photosensitive drums, transferring them to an intermediate transfer belt made of a polyimide, and conveying them to a secondary transfer roller 208. The intermediate transfer belt of the image forming unit 209 and the secondary transfer roller 208 are driven by an image forming drive stepping motor (M1) 120.

The sheet 203, which is conveyed to the registration roller 207, synchronizes with the image formation timing of the image forming unit 209 to be conveyed to the secondary transfer roller 208, and the visible toner image formed by the image forming unit 209 is secondary transferred to the sheet 203. The sheet 203, having passed the secondary transfer roller 208, passes by a before-fixing sensor 144, and then the visible toner image is fixed thereto by a thermal fixation roller 210, and the sheet 203 is discharged to a sheet discharge tray 211. The thermal fixation roller 210 is driven by a fixing drive stepping motor 140.

Between the secondary transfer roller 208 and the thermal fixation roller 210, a sheet is caused to have slack by making a rotating speed of the thermal fixation roller 210 which is positioned downstream in a paper feeding direction be slower by just a pre-determined amount than the rotating speed of the secondary transfer roller 208. Because of this, the transfer by the secondary transfer unit is caused to be stable and loop control to prevent skewing the sheet is performed.

Here, the secondary transfer roller 208 which is driven by the image forming drive stepping motor 120 is connected to the main substrate 101, whereas the thermal fixation roller 210 that is driven by the fixing drive stepping motor 140 (M2) is controlled by the sub substrate 102. Therefore, even if control is performed so as to drive the two motors at the same speed, the sub substrate 102 which is positioned at a location close to a fixing heater receives an influence of a temperature change, and a slight deviation in a rotating speed with respect to that of the main substrate 101 occurs. As a result, by precision of the previously described loop control decreasing between the secondary transfer roller 208 and the thermal fixation roller 210, there is a problem in that image quality deterioration such as precision of the secondary transfer deteriorating, skewing of the sheet, or bending of a rear end of the sheet occurring.

In the above example, an example of the secondary transfer roller 208 and the thermal fixation roller 210 for which a maximum temperature difference is likely to occur was given. However, a similar problem occurs in a case where another sheet feed roller 204, the vertical path roller 205, the conveyance roller 206, or the like are driven by stepping motors respectively arranged in a plurality of sub substrates in a large-type image forming apparatus.

Specifically, in a case of conveying one sheet, although it is simultaneously gripped and conveyed by a plurality of rollers, there is a need for each to rotate at the same speed. However, as described above, if the frequency of an integrated oscillator changes due to heat generated by a motor itself or another heat source, problems arise in that a speed difference occurs for each roller, and pulling or bending or the like is generated for the sheet, causing damage to the sheet.

First Embodiment

Explanation is given below regarding an embodiment according to the present invention. Although description of an image forming apparatus according to the present embodiment is given premised upon the apparatus configuration illustrated in FIG. 5, there is no limitation to this, and it may be another configuration.

[Apparatus Configuration]

Figure 6:
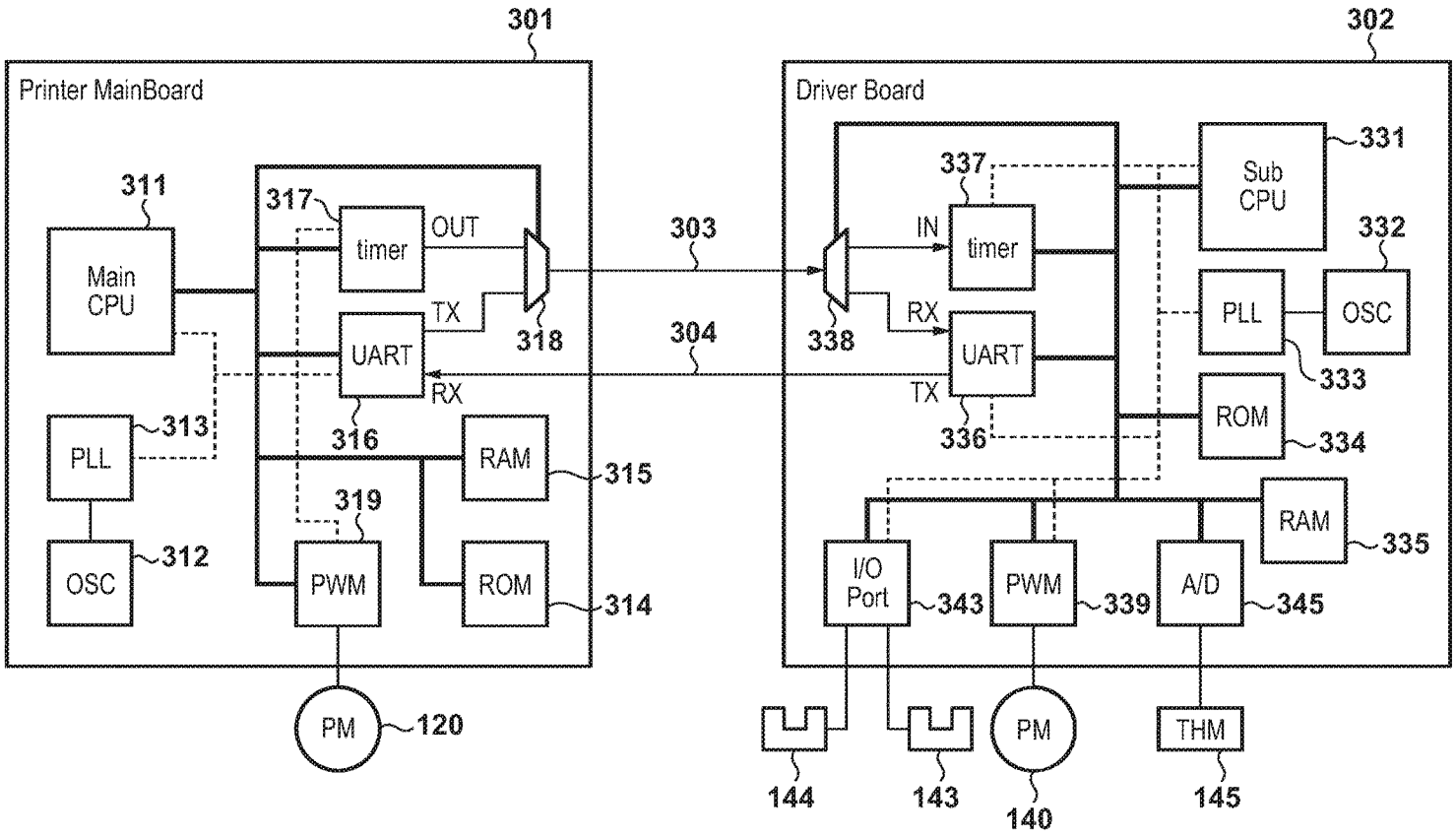
FIG. 6 is a view of an example of a circuit arrangement according to the present invention.

FIG. 6 is used to give a description regarding a control unit used in the image forming apparatus according to the present embodiment. The control unit includes a main substrate 301 (a printer main board) and a sub substrate 302 (a driver board). The main substrate 301 and the sub substrate 302 are connected by two serial communication signal lines (a serial communication transmission signal line 303 and a serial communication received signal line 304).

The main substrate 301 is configured by including a main CPU 311 (a first control unit), a clock oscillator 312, a PLL circuit 313, a ROM 314, a RAM 315, a UART-I/F 316, a timer 317, a selector 318, and a PWM control unit 319. The main substrate 301 is a control unit for outputting instructions to the control substrate of each unit of the image forming apparatus, and controlling overall control timing.

The main CPU 311 operates by reading a program stored in the ROM 314. The RAM 315 saves work data when the main CPU 311 performs a calculation.

The clock oscillator 312 outputs a clock (here assumed to be 4 MHz) for causing the main CPU 311 to operate. After multiplying the clock from the clock oscillator 312 by 20 in accordance with a phase synchronization circuit, the PLL circuit 313 supplies it to the main CPU 311, the UART-I/F 316, the timer 317, and the PWM control unit 319.

The UART-I/F 316 is an asynchronous type two-line serial interface, and performs transmission/reception of serial signals with the sub substrate 302. Out of these, a transmission signal is sent via the selector 318 to the sub substrate 302 which is connected to the serial communication transmission signal line 303. Similarly, a reception signal is sent from the sub substrate 302 and is received via the serial communication received signal line 304.

With respect to 8 bits of data designated from the main CPU 311, the UART-I/F 316 has a function of adding 1 bit for a start bit to the head thereof and 1 bit for a stop bit to the end thereof, and sending it 1 bit at a time as a serial signal at a predetermined speed. Here the predetermined speed is assumed to be 76800 bps. The UART-I/F 316 further has a function of, for a serial signal sent from a connection destination, receiving 1 bit at a time after detecting a start bit, and collecting data until the stop bit to transfer it to the main CPU 311 as one byte of data. By repeating the above, the UART-I/F 316 can perform transmission/reception of a byte sequence that is a plurality of bytes.

The timer 317 can output a negative logic pulse for a clock number designated from the main CPU 311 in advance, and is connected to the sub substrate 302 via the selector 318.

The selector 318 has a function of selecting and outputting, based on a setting from the main CPU 311, the transmission signal of the UART-I/F 316 or the output signal of the timer 317, and outputting the selected signal to the sub substrate 302. The selector 318 is normally set so as to output the transmission signal of the UART-I/F 316 to the sub substrate 302. Switching of the output of the selector 318 is described later in conjunction with a flowchart.

The PWM control unit 319 performs control for outputting a motor clock pulse signal for driving the image forming drive stepping motor 120. Between the PWM control unit 319 and the image forming drive stepping motor 120 there is a motor driver (not shown) for performing switching that converts a motor clock pulse signal into each phase signal of a 1-2 phase excitation, and this drives the image forming drive stepping motor 120. That is, the image forming drive stepping motor 120 corresponds to a load on the main substrate 301 side.

The sub substrate 302 is configured by including a sub-CPU 331 (a second control unit), a clock oscillator 332, a PLL circuit 333, a ROM 334, a RAM 335, a UART-I/F 336, a timer 337, a selector 338, a PWM control unit 339, an I/O port 343, and an A/D converter 345.

The sub substrate 302 is arranged in a location that is separated from the main substrate 301, and as described above is connected to the main substrate 301 by two serial communication signal lines (the serial communication transmission signal line 303 and the serial communication received signal line 304). For the separated location here, for example, a position in the image forming apparatus 201 where a temperature environment is different is raised.

The sub-CPU 331 is a CPU for controlling operation on the sub substrate 302, and operates by reading a program stored in the ROM 334. The RAM 335 saves work data when the sub-CPU 331 performs a calculation.

The clock oscillator 332 outputs a clock for causing the sub-CPU 331 to operate, and the PLL circuit 333 multiplies it by 40 in accordance with a phase synchronization circuit then supplies it to the sub-CPU 331, the UART-I/F 336, the timer 337, and the PWM control unit 339.

The UART-I/F 336 is an asynchronous type two-line serial interface, and performs transmission/reception of serial signals with the main substrate 301. Out of these, a reception signal is received via the selector 338 to the main substrate 301 which is connected to the serial communication transmission signal line 303. Similarly a transmission signal is sent to the main substrate 301 via the serial communication received signal line 304.

The timer 337 holds a counter for performing a time measurement, by clock units supplied from the PLL circuit 333, of a pulse width from a falling edge of a negative logic pulse signal until a rising edge. Here a result of measurement can be read from the sub-CPU 331.

The selector 338 has a function of outputting a signal input from the main substrate 301 to the reception signal of the UART-I/F 336 or the timer 337 by selecting based on a setting from the sub-CPU 331. The selector 338 is normally set so as to output the input signal from the main substrate 301 to the UART-I/F 336. Switching of the output of the selector 338 is described later in conjunction with a flowchart.

The PWM control unit 339 performs control for outputting a motor clock pulse signal for driving the fixing drive stepping motor 140. That is, the fixing drive stepping motor 140 corresponds to a load on the sub substrate 302 side. As described above, because the image forming drive stepping motor 120 and the fixing drive stepping motor 140 are arranged at separated positions, there is a configuration in which control is performed from a PWM circuit for each different substrate (here this is the main substrate 301 and the sub substrate 302).

A registration sensor 143 and the before-fixing sensor 144 are connected to the I/O port 343. By the registration sensor 143, a timing at which a sheet enters/is discharged from between the registration roller 207—the secondary transfer roller 208 is detected. By the before-fixing sensor 144, a timing at which a sheet enters/is discharged from between the secondary transfer roller 208—the thermal fixation roller 210 is detected.

The A/D converter 345 is connected to a thermistor 145 arranged near the sub substrate 302, and by converting a temperature in a vicinity of the sub substrate 302 into a 10-bit digital value, it is possible to read a temperature of the sub-CPU 331.

[Data Structure]

Figure 7:
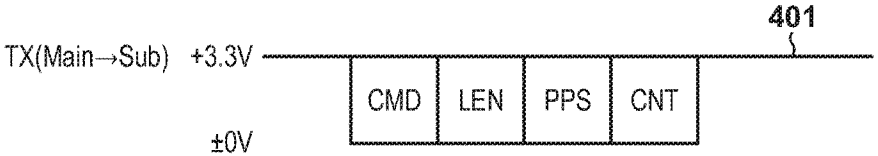
FIG. 7 is a view illustrating an example of a communication packet from a main substrate according to the present invention.
Figure 8:
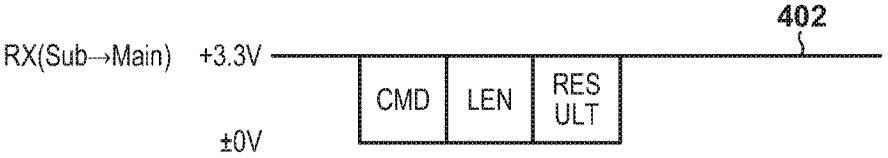
FIG. 8 is a view illustrating an example of a communication packet from a sub substrate according to the present invention.
Figure 9:
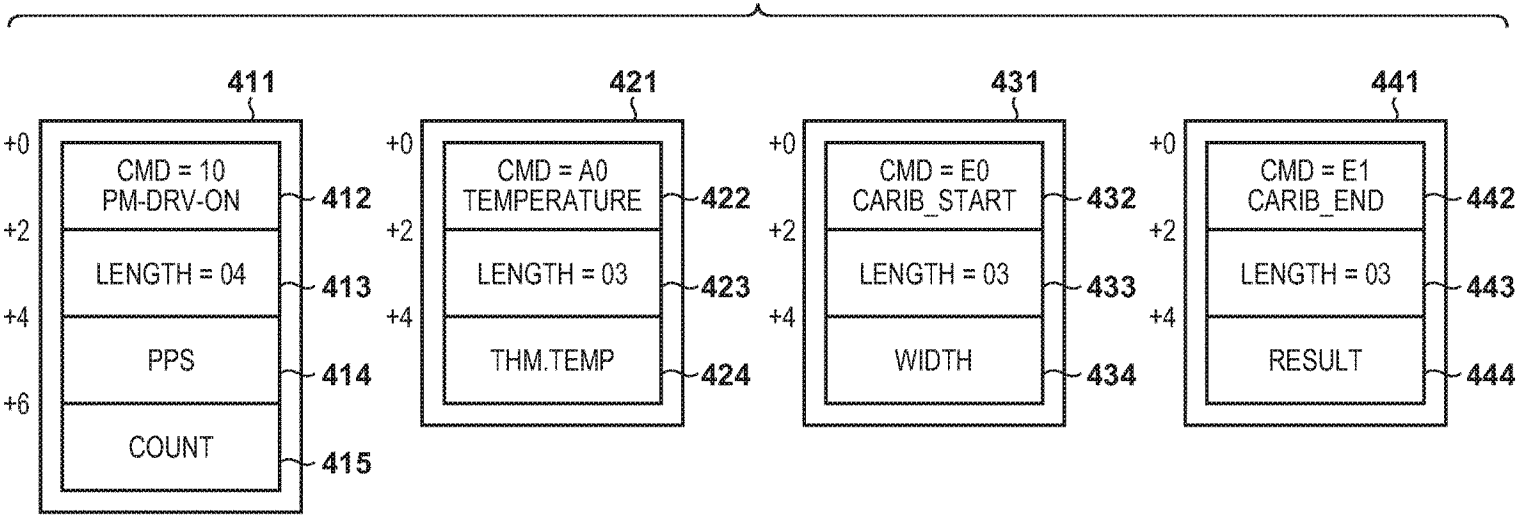
FIG. 9 is a view illustrating an example configuration of a communication packet according to the present invention.

Next, FIG. 7 through FIG. 9 are used to give a description regarding the structure of data communicated between the UART-I/F 316 of the main substrate 301 and the UART-I/F 336 of the sub substrate 302.

Reference numeral 401 of FIG. 7 is an external form of a serial communication packet sent from the UART-I/F 316 of the main substrate 301. It is +3.3V at a time of no communication, and successively outputs a variable-length packet one byte at a time by an asynchronous method. The case of the reference numeral 401 is an example of a 4-byte serial communication packet.

Reference numeral 402 of FIG. 8 is an external form of a serial communication packet sent from the UART-I/F 336 of the sub substrate 302. It is +3.3V at a time of no communication, and successively outputs a variable-length packet one byte at a time by an asynchronous method. The case of the reference numeral 402 is an example of a 3-byte serial communication packet.

FIG. 9 depicts the details of a packet communicated between the UART-I/F 316 of the main substrate 301 and the UART-I/F 336 of the sub substrate 302.

A stepping motor drive instruction packet 411 is a packet for designating stepping motor driving and is sent from the main substrate 301 to the sub substrate 302. A command portion 412 includes ID=10 indicating a command for designating stepping motor driving. A packet length portion 413 indicates a length of the packet. A speed designation portion 414 indicates a speed designation value for indicating a driving speed of the fixing drive stepping motor 140. A number of pulses designation portion 415 indicates a number of pulses designation value for indicating a number of driving pulses of the fixing drive stepping motor 140.

As an example, assume that the main CPU 311 sends the stepping motor drive instruction packet 411 from the UART-I/F 316 after designating the speed designation value=300 PPS in the speed designation portion 414, and a number of pulses designation value=200 pulses in a number of pulses designation portion 415. The sub-CPU 331 receives this by the UART-I/F 336, and controls the PWM control unit 339 to cause the fixing drive stepping motor 140 to be driven at 300 PPS for 200 pulses.

A temperature notification packet 421 is a packet for notifying a conversion result of the A/D converter 345 of the sub substrate 302 to the main substrate 301. Because the thermistor 145 is connected to the A/D converter 345, it is possible to notify the ambient temperature of the sub substrate 302 to the main substrate 301. A command portion 422 includes ID=AO for indicating a command for notifying a temperature from the sub substrate 302 to the main substrate 301. A packet length portion 423 indicates a length of the packet. A notified temperature portion 424 is a portion in which a 10-bit digital value resulting from performing A/D conversion on an output voltage of the thermistor 145 is stored, and here a value that the sub-CPU 331 converts to a temperature with units of 0.1 degrees is stored.

The temperature notification packet 421 is periodically sent by the sub-CPU 331 to the main substrate 301 side via the UART-I/F 336. As an example, although it is assumed that the temperature notification packet 421 is sent from the sub-CPU 331 at 1 second intervals, there is no limitation to this. Upon receiving the temperature notification packet 421 by the UART-I/F 316, the main CPU 311 saves it as temperature information of the sub substrate 302 in the RAM 315 which is a storage unit.

A frequency fluctuation adjustment request packet 431 is a packet for requesting adjustment (correction) of a frequency, and is sent from the main substrate 301 to the sub substrate 302. A command portion 432 includes ID=E0 indicating a command for designating frequency fluctuation adjustment. A packet length portion 433 indicates a length of the packet. A pulse width designation portion 434 indicates a theoretical value for a pulse width of a frequency fluctuation adjustment pulse output by the main substrate 301. Note that, here a frequency fluctuation adjustment request packet is also referred to as a calibration command.

A frequency fluctuation adjustment complete packet 441 is a packet for notifying to the effect that adjustment of the frequency is complete, and is sent from the main substrate 301 to the sub substrate 302. A command portion 442 includes ID=E1 for indicating a command for indicating frequency fluctuation adjustment complete. A packet length portion 443 indicates a length of the packet. A result portion 444 indicates a result of frequency fluctuation adjustment executed by the sub substrate 302.

Description is given later regarding the usage method of the frequency fluctuation adjustment complete packet 441 and the frequency fluctuation adjustment request packet 431.

[Operational Flow]

Figure 10:
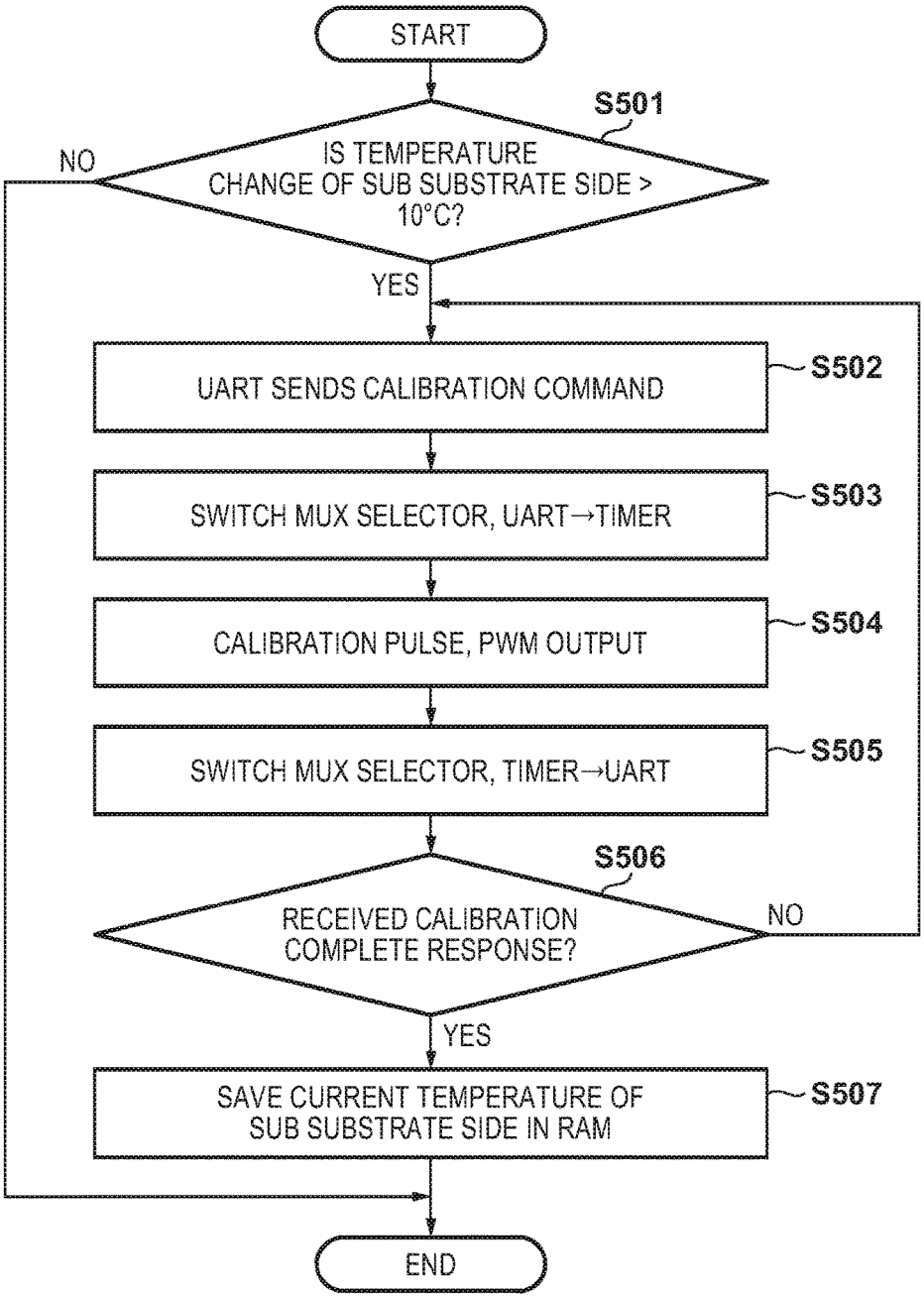
FIG. 10 is a flowchart in a CPU of the main substrate according to the present invention.
Figure 11:
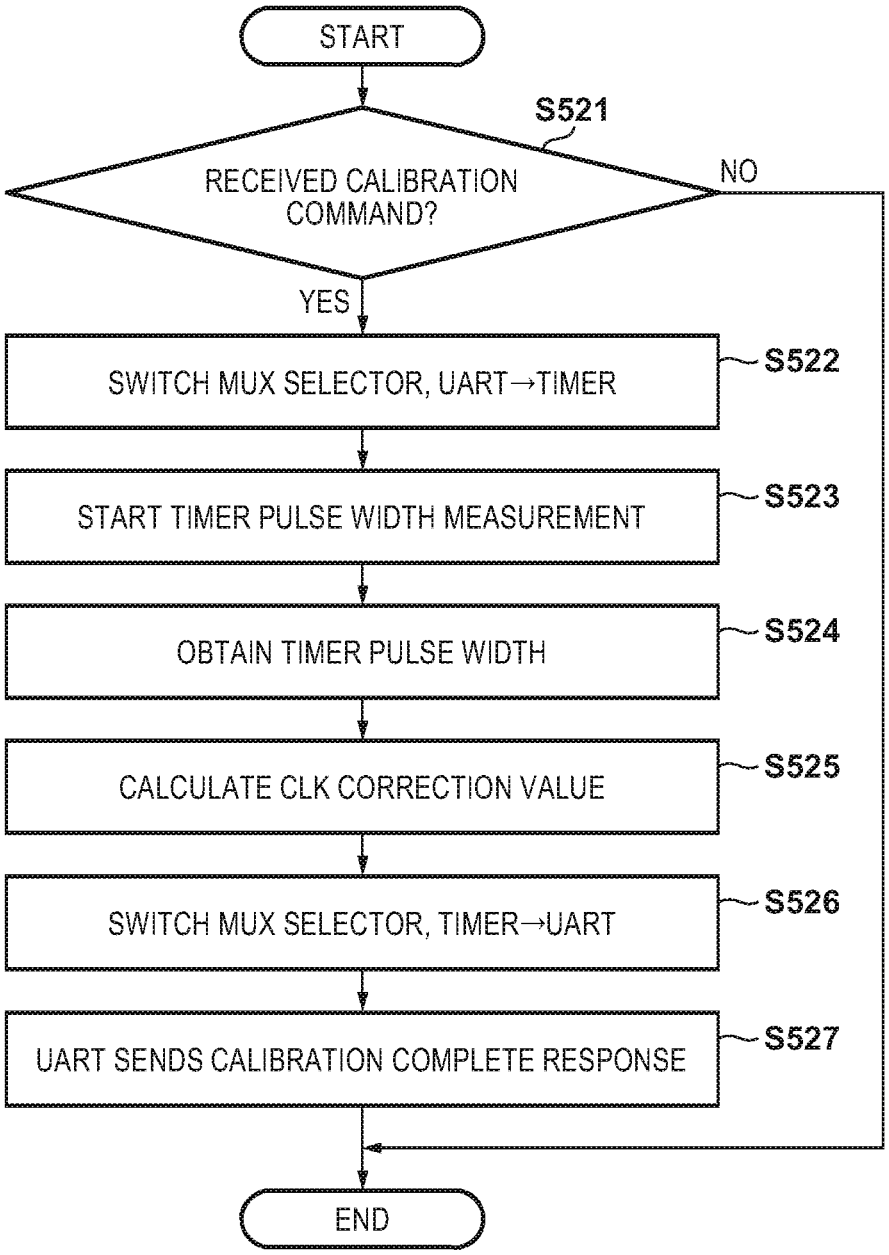
FIG. 11 is a flowchart in a CPU of the sub substrate according to the present invention.

FIG. 10 and FIG. 11 are used to give a description regarding frequency synchronization control of the main substrate 301 and the sub substrate 302. Step S501 through step S507 of FIG. 10 are a flowchart illustrating a processing procedure that the main CPU 311 performs.

When processing is started, in step S501 the main CPU 311 determines a temperature change of the sub substrate 302 side. Specifically, the main CPU 311 compares a temperature of the sub substrate 302 side received last and saved in the RAM 315 with a temperature at a previous synchronization control time that is similarly saved in the RAM 315, and determines whether a fluctuation value is greater than a predetermined threshold. Here the predetermined threshold is assumed to be 10° C., but there is no limitation to this. If the fluctuation value exceeds 10° C. (YES in step S501), the processing proceeds to step S503, and if it does not exceed 10° C., this processing flow terminates.

In step S502, the main CPU 311 sends the frequency fluctuation adjustment request packet 431 from the UART-I/F 316. As described above, at this point in time, at the selector 318, output to the sub substrate 302 is the UART-I/F 316 side.

In step S503, the main CPU 311 switches the output to the sub substrate 302 at the selector 318 to the timer 317 side.

In step S504, the main CPU 311 outputs a pulse for frequency synchronization from the timer 317. Detail of the pulse for frequency synchronization is described later.

In step S505, the main CPU 311 switches the output to the sub substrate 302 at the selector 318 to the UART-I/F 316 side.

In step S506, the main CPU 311 confirms whether the frequency fluctuation adjustment complete packet 441 from the sub substrate 302 side has been received by the UART-I/F 316. If a frequency fluctuation adjustment complete packet has been received (YES in step S506) the processing proceeds to step S507, and if not received (NO in step S506), step S502 is returned to, and the processing is retried.

In step S507, the main CPU 311 saves the current temperature of the sub substrate 302 side to the RAM 315, for a subsequent adjustment. As described above, it is assumed that the temperature of the sub substrate 302 side is sent every 1 second from the sub substrate 302, and the main substrate 301 holds a received temperature for a point in time nearest to when step S507 is performed as the temperature for when calibration completes. This processing flow is then terminated.

Meanwhile, step S521 through step S527 of FIG. 11 are a flowchart illustrating a processing procedure that the sub-CPU 331 performs.

When processing is started, in step S521, the sub-CPU 331 determines whether the frequency fluctuation adjustment request packet 431 from the main substrate 301 side has been received by the UART-I/F 336. As described above, at this point in time, at the selector 338, output to the sub substrate 302 is the UART-I/F 336 side. If the frequency fluctuation adjustment request packet 431 has been received (YES in step S521) the processing proceeds to step S522, and if not received (NO in step S521), this processing flow terminates.

In step S522, the sub-CPU 331 switches the input destination for the input from the main substrate 301 at the selector 338 to the timer 337 side.

In step S523, the sub-CPU 331 measures, by the timer 337, the width of the pulse for frequency synchronization output from the main substrate 301. Measurement of the pulse for frequency synchronization is described later.

In step S524, the sub-CPU 331 obtains the width of the pulse measured by the timer 337.

In step S525, the sub-CPU 331 calculates a motor pulse clock correction value in accordance with the width of the pulse measured by the timer 337. A calculation method is described later.

In step S526, the sub-CPU 331 switches, at the selector 338, an input destination of the input from the main substrate 301 to the UART-I/F 336 side from the timer 337.

In step S527, the sub-CPU 331 sends the frequency fluctuation adjustment complete packet 441 to the main substrate 301 side by the UART-I/F 336. This processing flow is then terminated.

[Output and Measurement of Pulse for Frequency Fluctuation Adjustment]

Figure 12:
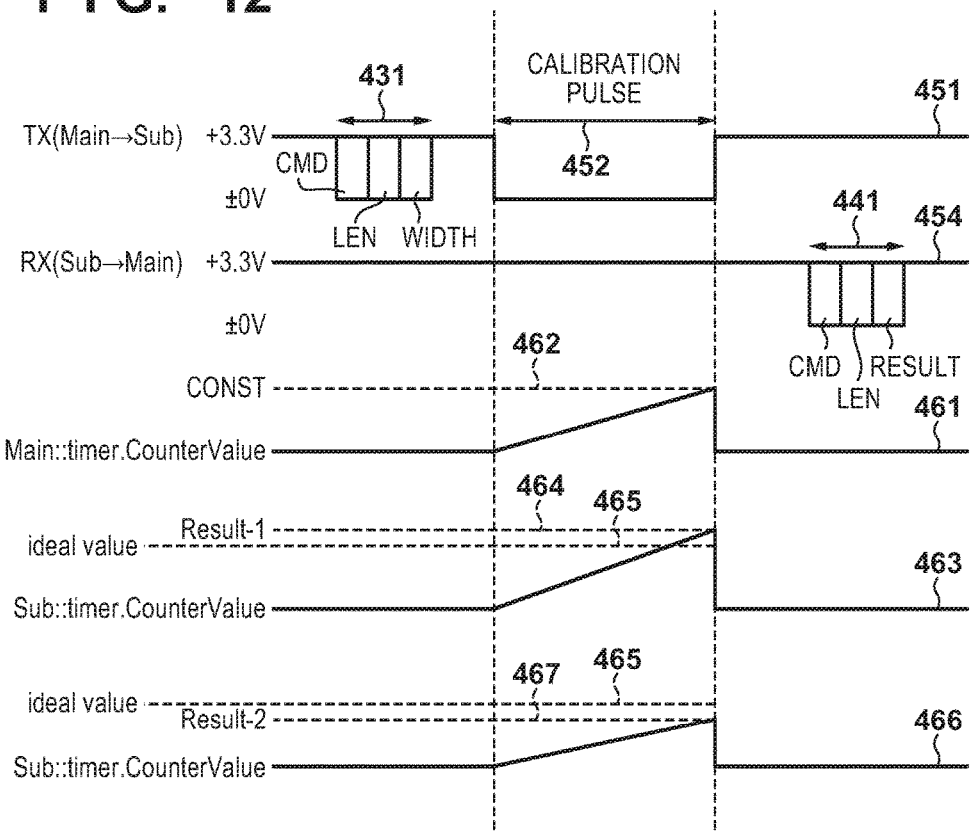
FIG. 12 is a timing chart for output waveforms at a time of frequency adjustment, for the main substrate and the sub substrate.

Next, FIG. 12 is used to give a description regarding measure of the output of the pulse for frequency fluctuation adjustment in step S504 of FIG. 10 and step S523 of FIG. 11.

A waveform 451 is a waveform that indicates a signal level of the serial communication transmission signal line 303 for output by the main substrate 301. The waveform 451 indicates that, after the main substrate 301 outputs the frequency fluctuation adjustment request packet 431 in step S502, the selector 318 is switched to, and a pulse for frequency synchronization 452 is output in step S504. A waveform 454 is a waveform that indicates a signal from sub substrate 302 to main substrate 301.

The pulse for frequency synchronization 452 is a signal that the timer 317 outputs to the sub substrate 302. Whereas a signal output by the timer 317 is an H-level at a time of normal non-communication, it is controlled so that an L-level is output for only the interval of the pulse for frequency synchronization 452. At this point, a value of an internal counter of the timer 317 is controlled to be like a waveform 461. In other words, a count is started simultaneously with the timer 317 starting output of the L-level, and increments by 1 in accordance with each clock input from the PLL circuit 313. The value of the internal counter of the timer 317 increases as illustrated by the waveform 461, and when it matches a timer constant 462, the timer 317 returns output to the H-level. The value designated by the pulse width designation portion 434 of the frequency fluctuation adjustment request packet 431 is a value that is the same as the timer constant 462.

A waveform 463 indicates the value of an internal counter (hereinafter, an internal counter value C') that the timer 337 counted for the pulse for frequency synchronization input from the sub substrate 302 from a falling edge. Upon the input being changed to the L-level, simultaneously a count is started, and increments by 1 in accordance with each clock input from the PLL circuit 333. When the inputted signal level returns to the H-level, counting is stopped. In this way, the width of a pulse for frequency synchronization output by the main substrate 301 is measured by the sub substrate 302 side. In other words, the pulse for frequency synchronization output by the main substrate 301 is based on the clock frequency of the clock oscillator 312, but when measuring on the sub substrate 302 side, measurement is performed based on the clock frequency of the clock oscillator 332. Therefore, if the frequency of the clock oscillator 312 and the frequency of the clock oscillator 332 are different, a designated pulse width and a measured pulse width will become different values.

In a case where the frequency of the clock oscillator 312 is the same as the frequency of the clock oscillator 332, if, for the internal counter value C' of the timer 337 at this point, a difference has occurred, then it is an error of an amount in proportion to a phase shift for oscillation timing. Therefore, an ideal value 465 thereof can be determined to be the same value as the timer constant 462.

However, if the frequency of the clock oscillator 332 is higher than the frequency of the clock oscillator 312, counting completes at an internal count value larger than the ideal value 465 illustrated in the result 464.

In addition, if the frequency of the clock oscillator 332 is lower than the frequency of the clock oscillator 312, when a waveform 466 is indicated as an example of the internal counter value C', incrementing terminates at an internal count value smaller than the ideal value 465 as illustrated by a result 467.

Calculation of the clock correction value in step S525 of FIG. 11 is performed by comparing the internal count value C of the timer 337 and the timer constant 462 sent by the frequency fluctuation adjustment request packet 431. Specifically, a frequency ratio D of the clock oscillator 312 and the clock oscillator 332 is frequency ratio D=(the internal count value C)/(the timer constant 462). The sub substrate 302 saves the frequency ratio D in the RAM 335. Normally, the frequency ratio D takes a value that is substantially close to 1. For example, in a case where the frequency of the clock oscillator 312 is 4.000 MHz and the frequency of the clock oscillator 332 is 3.990 MHz, the frequency ratio D becomes 0.9975.

In addition, the frequency ratio D is stored in a result portion 444 of the frequency fluctuation adjustment complete packet 441 sent in step S527 of FIG. 11, and sent to the main substrate 301.

Figure 13:
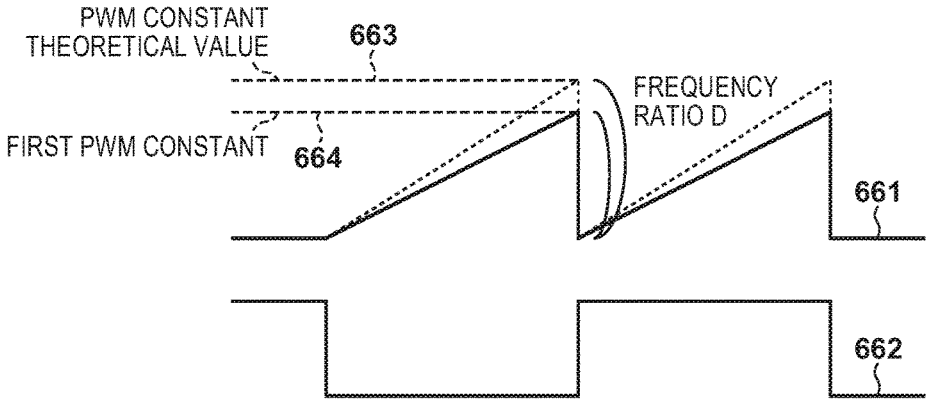
FIG. 13 is a view for describing a motor driving pulse to which the present invention is applied.

Next, FIG. 13 is used to give a description regarding reflecting the frequency ratio D which is obtained by calculating.

A waveform 661 illustrates a value of an internal counter of the PWM control unit 339 that drives the fixing drive stepping motor 140 connected to the sub substrate 302. The waveform 661 is, as illustrated by an output 662, configured so as to perform a toggle output of the output 662 if the internal counter of the PWM control unit 339 matches a timer constant.

A PWM constant theoretical value 663 is a theoretical value for a value for determining the width for 1 pulse determined in accordance with a motor driving speed (PPS) notified by the stepping motor drive instruction packet 411 from the main CPU 311. If the frequency of the clock oscillator 332 of the sub substrate 302 is slightly lower than the clock oscillator 312, a first PWM constant 664 indicates a frequency of the PWM control unit 339 that considers the frequency ratio D with respect to the PWM constant theoretical value 663. The first PWM constant 664 is determined by the following equation.

The first PWM constant 664=the frequency ratio D×the PWM constant theoretical value 663

As an example, if the width of the pulse for frequency synchronization 452 measured in accordance with the flowcharts of FIG. 10 and FIG. 11 is 1000 clocks and the internal count value C is measured at 980, the frequency ratio D becomes 0.980. At this point, if the PWM constant theoretical value 663 is 500 clocks, when the frequency ratio is considered based on the above equation, it is ideal to have approximately 490 clocks. Because of this, pulse output that corrects fluctuation of the frequency becomes possible by setting the first PWM constant 664 to 490 clocks, and it is possible for the fixing drive stepping motor 140 connected to the sub substrate 302 to make a speed deviation with the main substrate 301 be very small.

Thus, in an image forming apparatus having a configuration in which CPUs or the like arranged divided among a plurality of substrates are connected by serial communication signal lines, with performance of a frequency synchronization adjustment instruction by serial communication from the main substrate as a trigger, a pulse signal for frequency synchronization is sent by a serial communication signal line from the main substrate. A result of measuring this width by a sub substrate is reflected in a width of a motor driving pulse. Because of this, even if an oscillator that receives an influence of temperature is provided in each substrate, it is possible to synchronize a motor driving speed between the main substrate and the sub substrate.

In addition, in accordance with the above control of a motor driving signal, it is possible to realize an image forming apparatus that suppresses image degradation due to skewing, pulling or bending of a sheet without adding a signal line or the like.

Second Embodiment

Explanation will be given regarding a second embodiment according to the present application invention. Note that, regarding communication packets exchanged between the main substrate 301 and the sub substrate 302 explained by using FIG. 6 through FIG. 12, explanation is omitted because they are the same as in the first embodiment.

Figure 14:
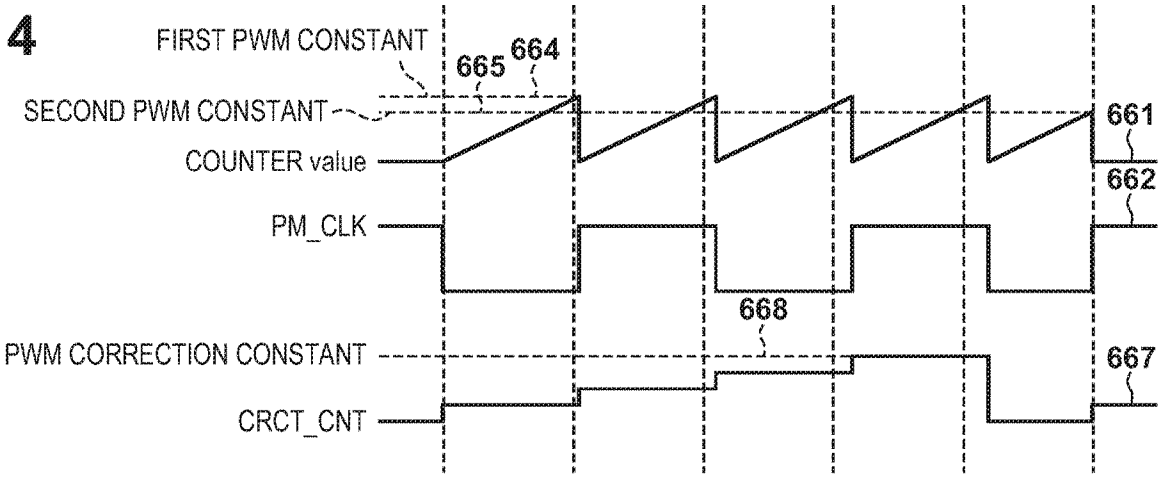
FIG. 14 is a view for describing a motor driving pulse to which the present invention is applied.
Figure 15:
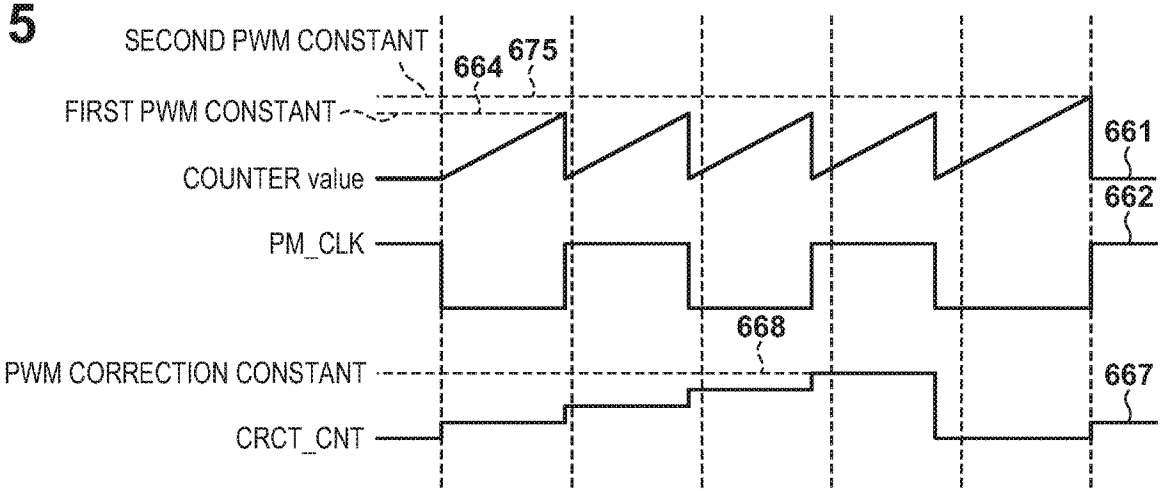
FIG. 15 is a view for describing a motor driving pulse to which the present invention is applied.

If the period of the pulse output by the PWM control unit 339 is short, there may be cases in which a value below the decimal point is achieved after multiplying the frequency ratio D with the clock cycle of the PWM control unit 339 as stated in the first embodiment, and it is not possible to effectively make a correction. FIG. 14 and FIG. 15 are used to give an explanation regarding correction means in such a case.

Similarly to FIG. 12, the waveform 661 of FIG. 14 illustrates the value of the internal counter of the PWM control unit 339 that drives the fixing drive stepping motor 140 connected to the sub substrate 302. The waveform 661 is, as illustrated by the output 662, configured so as to perform a toggle output of the output 662 if the internal counter of the PWM control unit 339 matches a timer constant.

The first PWM constant 664 is the PWM constant of the PWM control unit 339. The first PWM constant 664 is a value that considers the frequency ratio D in a value for determining the width for 1 pulse determined in accordance with a motor driving speed (PPS) notified by the stepping motor drive instruction packet 411 from the main CPU 311. A second PWM constant 665 is a second PWM constant indicating a correction value smaller than the first PWM constant 664. A waveform 667 indicates a value of a correction amount counter which increments each time the output 662 is toggled. The value of the correction amount counter returns to 0 when it matches a PWM correction constant 668 that is also determined in accordance with the frequency ratio D.

The PWM control unit 339 normally returns the value of the internal counter to 0 by it matching the first PWM constant 664 as illustrated by the waveform 661. However, as illustrated by the waveform 667, when the value of the correction amount counter is 0, the internal counter returns to 0 by matching the second PWM constant 665.

The first PWM constant 664, the second PWM constant 665, and the PWM correction constant 668 are decided in accordance with the following equations.

The first PWM constant 664=the frequency ratio D×a PWM theoretical value (rounded below the decimal point)

The second PWM constant 665=(the first PWM constant 664)−1

The PWM correction constant 668=1/{(the first PWM constant 664)−(the frequency ratio D×the PWM theoretical value)}

As an example, if the width of the pulse for frequency synchronization 452 measured in accordance with the flowcharts of FIG. 10 and FIG. 11 is 1000 clocks and the internal count value C is measured at 980, the frequency ratio D becomes 0.980. At this point, if the PWM theoretical value is 10 clocks, when the frequency ratio is considered, it is ideal to have approximately 9.80 clocks. However, it is not possible to correct by a resolution that is less than or equal to 1 clock.

Accordingly, the first PWM constant 664 is set to 10 clocks by rounding below the decimal point. Furthermore, the second PWM constant 665 is set to 9 clocks which is 1 smaller than that, and the PWM correction constant 668 is set to 5. As a result, every 5 pulses a pulse having width of 9 clocks is output, and something that was 50 clocks as the clocks for 5 pulses before correction becomes 49 clocks. Because of this, the clocks become a positive integer, and it is possible to be supported by the resolution of the sub substrate 302.

Accordingly pulse output for a number of clocks proportional to a frequency becomes possible with a resolution less than 1 clock, and it is possible for the fixing drive stepping motor 140 connected to the sub substrate 302 to make deviation of speed with respect to the main substrate 301 be very small. Note that, if the frequency ratio D× the PWM theoretical value is an integer from the start, there is no limitation to this.

Next, FIG. 15 is used to describe a correction example when the frequency of the clock oscillator 332 slightly higher than the clock oscillator 312.

Separate from the first PWM constant 664 that indicates the frequency of the PWM control unit, there is a second PWM constant 675 indicating a correction amount for indicating a correction value that is greater than the first PWM constant 664. Regarding the correction amount counter and the PWM correction constant 668, it is similar to with FIG. 14.

The second PWM constant 675 and the PWM correction constant 668 are decided in accordance with the following equations.

The first PWM constant 664=the frequency ratio D×a PWM theoretical value (rounded below the decimal point)

The second PWM constant 675=(the first PWM constant 664)+1

The PWM correction constant 668=1/{(the first PWM constant 664)−(the frequency ratio D×the PWM theoretical value)}

As an example, if the width of the pulse for frequency synchronization 452 (=the timer constant 462) is 1000 clocks and the internal count value C is measured at 1033, the frequency ratio D becomes 1.033. At this point, if the first PWM constant 664 is 10 clocks, considering the frequency ratio D approximately 10.33 clocks is ideal. However, it is not possible to correct by a resolution that is less than or equal to 1 clock.

Accordingly, the first PWM constant 664 is set to 10 clocks by rounding below the decimal point. Furthermore, the second PWM constant 675 is set to 11 clocks which is 1 larger than that, and the PWM correction constant 668 is set to 3. As a result, every 3 pulses a pulse having width of 11 clocks is output, and something that was 30 clocks as the clocks for 30 pulses before correction becomes 31 clocks.

Accordingly pulse output for a number of clocks proportional to a frequency becomes possible with a resolution less than 1 clock, and it is possible for the fixing drive stepping motor 140 connected to the sub substrate 302 to make a speed difference deviation with respect to the main substrate 301 be very small.

Thus, in a printer engine having a configuration in which a CPUs or the like are arranged to be divided between a plurality of substrates and are connected by serial communication signal lines, when correcting frequency shift due to a temperature fluctuation of a quartz oscillator between a main substrate and a sub substrate, it is possible to synchronize a driving speed of a motor by preventing a pulse width desired to be output from becoming a value smaller than 1 clock (in other words the resolution).

In addition, even if an error is accumulated when a signal having a high clock frequency is output for a long time, it becomes possible to realize an image forming apparatus that suppresses image degradation due to skewing, pulling, or bending of a sheet, without, for example, increasing the clock frequency.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-228089, filed Nov. 20, 2015, which is hereby incorporated by reference herein in its entirety.

What is claimed is:

1. An image forming apparatus, comprising:

a first control unit provided with a first oscillator internally and configured to perform control of a load by outputting a pulse signal based on a clock signal output by the first oscillator; and a second control unit provided with a second oscillator internally, connected to the first control unit by a serial communication signal line, and configured to perform control of a load by outputting a pulse signal based on a clock signal output by the second oscillator, wherein the second control unit measures a width of the pulse signal output from the first control unit via the serial communication signal line, upon receiving an adjustment request from the first control unit;

compares a pulse signal width designated by the adjustment request with the measured width of the pulse signal; and corrects, based on a result of the comparing, the width of the pulse signal that is based on the clock signal output by the second oscillator.

2. The image forming apparatus according to claim 1, wherein the first control unit, triggered by sending of the adjustment request via the serial communication signal line, switches output to the second control unit via the serial communication signal line to be a pulse signal of a predetermined width.

3. The image forming apparatus according to claim 2, wherein the second control unit, triggered by having received the adjustment request from the first control unit via the serial communication signal line, switches to measurement of a width of a pulse signal with respect to output received via the serial communication signal line.

4. The image forming apparatus according to claim 2, wherein the second control unit periodically obtains a temperature of a vicinity and notifies the obtained temperature to the first control unit; and when operation with respect to the adjustment request has completed, notifies the first control unit accordingly; and wherein the first control unit comprises a storage unit configured to store a latest temperature notified from the second control unit when a notification that operation with respect to the adjustment request has completed is received; and newly sends the adjustment request via the serial communication signal line if a difference between a temperature newly notified from the second control unit and the temperature stored by the storage unit is greater than a predetermined threshold.

5. The image forming apparatus according to claim 1, wherein the second control unit, based on a ratio of the pulse signal width designated by the adjustment request and the measured width of the pulse signal, corrects the width of the pulse signal based on the clock signal output by the second oscillator.

6. The image forming apparatus according to claim 5, wherein the second control unit corrects the width of the pulse signal to be a width that can be supported by a resolution of the clock signal output by the second oscillator.

7. The image forming apparatus according to claim 1, wherein the load controlled by the second control unit is a stepping motor.

8. The image forming apparatus according to claim 1, wherein the first control unit and the second control unit are arranged at positions having different temperature environments in the image forming apparatus.

9. The image forming apparatus according to claim 1, wherein the serial communication signal line is configured from two lines of a first signal line for outputting a signal to the second control unit from the first control unit, and a second signal line for outputting a signal to the first control unit from the second control unit.

* * * * *